United States Patent [19]

Pierce

[11] 4,192,385

[45] Mar. 11, 1980

[54] FIRE FIGHTING APPARATUS

[75] Inventor: Leo P. Pierce, Shrewsbury, Mass.

[73] Assignee: Feecon Corporation, Westboro, Mass.

[21] Appl. No.: 945,539

[22] Filed: Sep. 25, 1978

[51] Int. Cl.[2] ..... A62C 37/00

[52] U.S. Cl. ..... 169/56; 98/29

[58] Field of Search ..... 169/56, 54, 57, 59, 169/60, 64, 26, 19, 91; 220/201, 202, 291; 236/49, DIG. 9; 98/29, 30, 36

[56] References Cited

U.S. PATENT DOCUMENTS

| | | | |
|---|---|---|---|
| 1,143,354 | 6/1915 | Bosch | 169/56 |
| 2,575,468 | 11/1951 | Rider | 169/60 |
| 3,669,350 | 6/1972 | White | 98/29 |
| 4,034,659 | 7/1977 | Raider | 98/36 |

OTHER PUBLICATIONS

Bilco Catalog, New Haven, Connecticut, 06505, 1976; See Models 'D-SH' and 'D-SV' of the Double Heat Fire Vents.

*Primary Examiner*—Kenneth W. Noland
*Attorney, Agent, or Firm*—Norman S. Blodgett; Gerry A. Blodgett

[57] ABSTRACT

Apparatus for opening an enclosure in response to operation of a foam generator, including an operative connection between the generator and the latch of the venting door.

9 Claims, 5 Drawing Figures

FIRE FIGHTING APPARATUS

BACKGROUND OF THE INVENTION

One of the most effective methods of controlling fires of all kinds is directing a stream of suitable foam onto the fire. This foam is usually generated by mixing air with a liquid consisting of water into which has been introduced a material, such as a protein, that assists in bubble formation. The foam has a double effect: it not only cools the burning material below the flash point, but it also deprives it of oxygen. A third advantage of foam is that, because of the small amount of water involved, possible damage to the materials in the fire area is minimized. For these reasons, it is increasingly a common practice to incorporate permanently-installed foam generators in buildings in place of the conventional solid-water sprinklers. Generally speaking, such a foam generator would be installed in the upper part of a large building enclosure and directed downwardly toward the portion of the enclosure most likely to have a fire. However, foam generators require fairly large amounts of air and it is preferable that the air used be cool and free of inflammable gases generated by a fire. These and other difficulties experienced with the prior art devices have been obviated in a novel manner by the present invention.

It is, therefore, an outstanding object of the invention to provide fire fighting apparatus for supplying fresh, cool air to a foam generator.

Another object of the present invention is the provision of apparatus combining a open vent and a foam generator in such a way that they begin their operations together.

A further object of the present invention is the provision of foam generating apparatus for association with a building, wherein fresh air is used instead of products of combusion.

It is another object of the instant invention to provide foam generating apparatus in which the air used in forming the foam does not contain hot combustible gases.

A still further object of the invention is the provision of venting apparatus for use with a foam generator, which apparatus can be operated either by a heat-fusible link or by the operation of the foam generator.

It is a further object of the invention to provide a fire fighting apparatus which is simple in construction, which can be readily manufactured from inexpensive materials, and which is capable of a long life of useful service with a minimum of maintenance.

It is a still further object of the present invention to provide fire fighting apparatus, including a venting door and a foam generator, in which the energy of fluid is not used only to operate the foam generator, but also to release the venting control apparatus are not necessary.

With these and other objects in view, as will be apparent to those skilled in the art, the invention resides in the combination of parts set forth in the spectification and covered by the claims appended hereto.

SUMMARY OF THE INVENTION

In general, the invention consists of a fire fighting apparatus having an air vent with a frame adapted to be mounted on the roof of a building and with a spring-loaded door hingedly mounted on the frame for movement from a closed position to an open position. A foam generator is provided having a housing mounted on the frame with a manifold adapted to receive fluid and with a spindle rotatably carried in the housing. The spindle has a turbine wheel which is rotated by the fluid and a fan for forming a flow of air to mix with the fluid to produce a foam. A latch retains the door in closed position and a locking element is engaged by a threaded portion of the spindle for movement (when the spindle rotates) to actuate the latch and release the door, so that it moves from closed position to open position.

More specifically, the latch is attached to a heat-fusible link, one end of which is connected to the frame to normally hold the latch in locking position and the door in closed position. The other end of the fusible link is connected to the frame by a pin that slides in an operature in the link and an aperature in the frame. The pin is spring-biased toward a position out of the apertures, but is normally retained in them by a use of a groove on one end of the pin engaged by a notch in the locking element. The locking element has a threaded bore which is engaged by the said threaded portion of the spindle.

BRIEF DESCRIPTION OF THE INVENTION

The character of the invention, however, may be best understood by reference to one of its structural forms, as illustrated by the accompanying drawings, in which:

FIG. 1 is a vertical sectional view of a fire fighting apparatus employing the principals of the present invention, FIG. 2 is a perspective view of a portion of the apparatus, FIG. 3 is an enlarged vertical sectional view of a portion of the apparatus, the view being taken on the line III—III of FIG. 1, FIG. 4 is a side view of the portion of the apparatus, as viewed from the line IV of FIG. 3, and FIG. 5 is an opposite side elevational view of the portion of the apparatus shown in FIG. 3 taken on the line V.

DESCRIPTION OF THE PREFERRED EMBODIMENT

Figure 1:
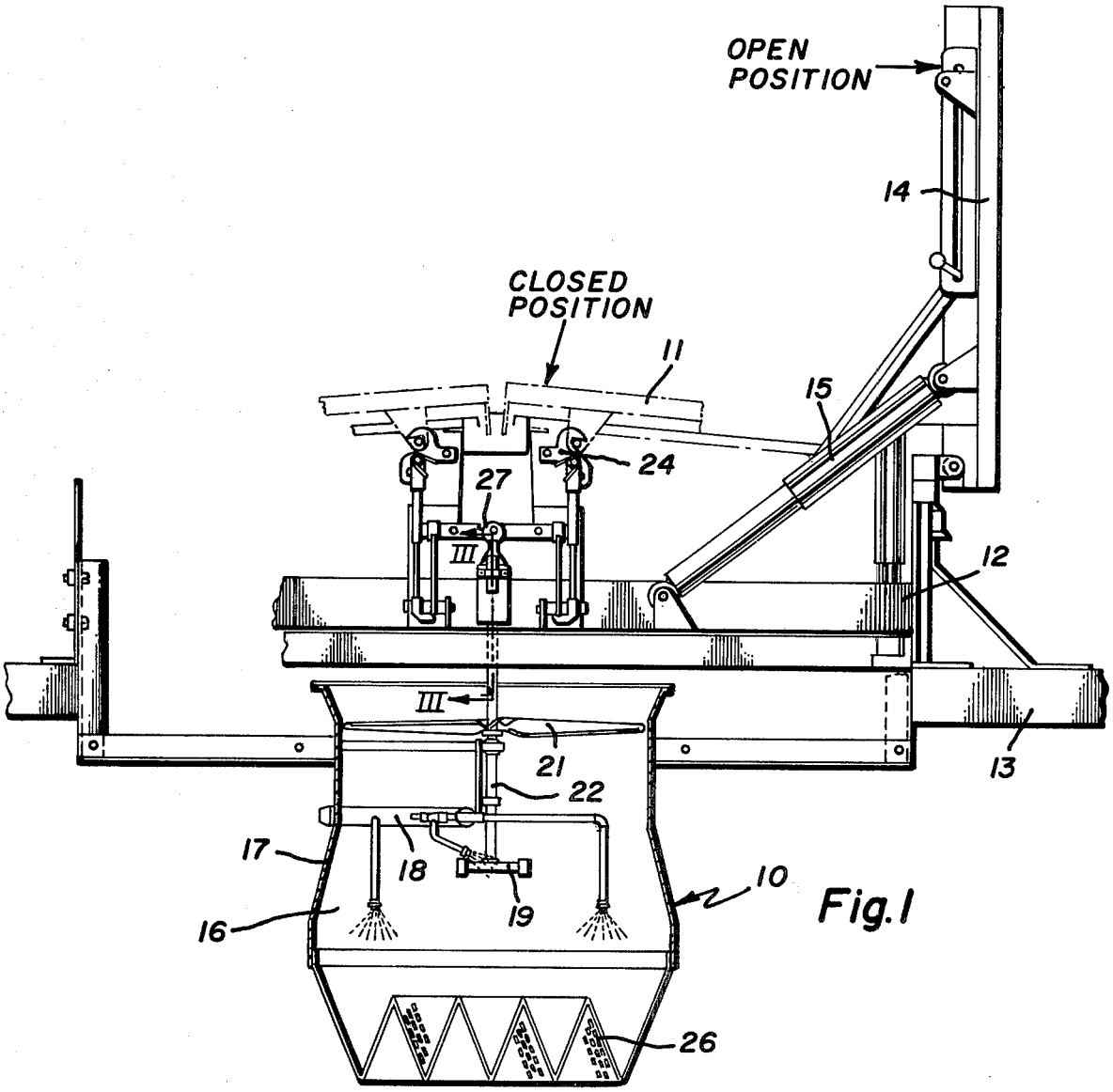

Referring first to FIG. 1, which best shows the general features of the invention, the fire fighting apparatus, indicated generally by reference numeral 10, is shown as including an air vent 11 having a frame 12 which is adapted to be mounted on the roof 13 of a building. The door 14 is biased by a spring 15 from a closed position to an open postion. A foam generator 16 is provided with a housing 17 mounted on the frame 12 and is provided with a manifold 18 adapted to receive the fire fighting fluid. In the preferred embodiment, this fluid is a mixture of water under pressure mixed with a foaming agent. The spindle 22 is rotatably carried in the housing 17 and carries a turbine wheel 19 for rotation by the fluid and a fan 21 for forming a flow of air to mix with the fluid to produce foam. The spindle has a threaded portion 23 (see FIG. 3). The latch 24 is effective to retain the door 14 in the closed position. The locking element 25 (see FIG. 3) is engaged by the threaded portion 23 of the spindle 22 and is moved (when the spindle rotates) to actuate the latch 24 and release the door, so that the spring 15 moves it from closed position to open position. The housing 17 of the foam generator 16 is of generally tubular shape and has a perforated discharge screen 26 at its lower end.

Figure 2:
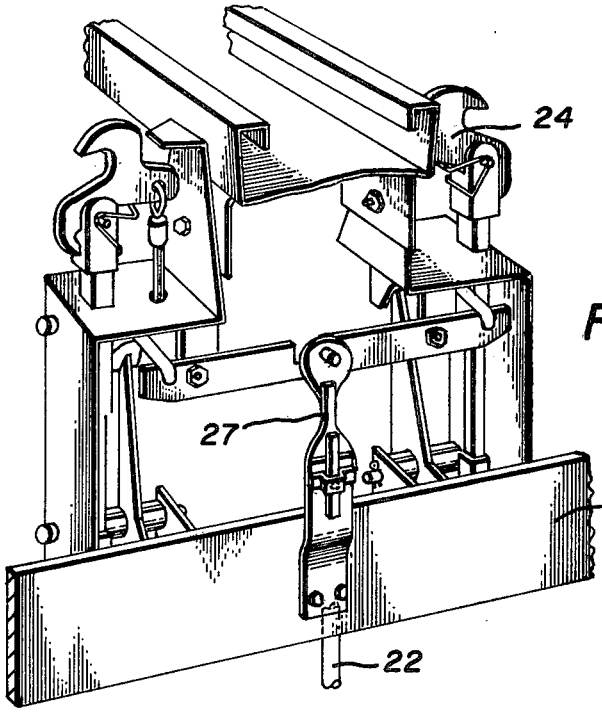

In FIG. 2 it can be seen that the latch 24 is attached to one end of a heat-fusible link 27, the other end of which is connected to the frame 12 normally to hold the latch in locking position and, therefore, to maintain the door 14 in closed position.

Figure 4:
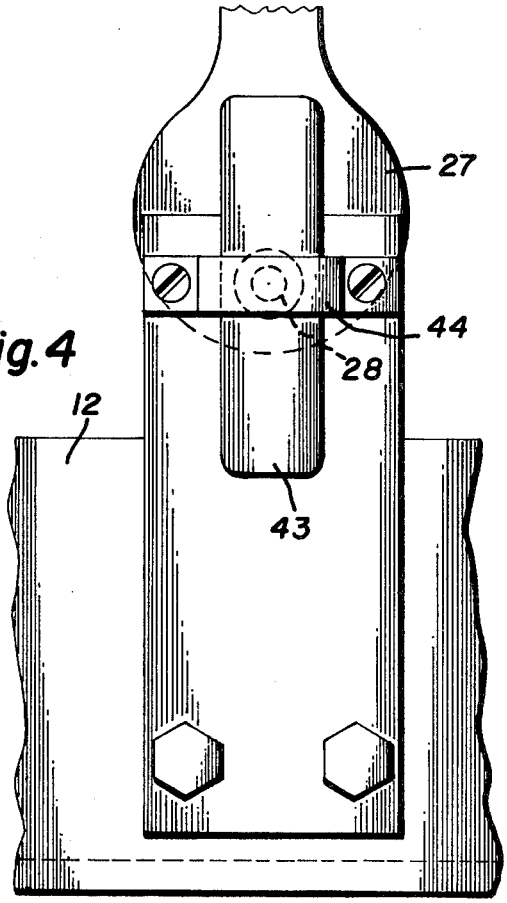
Figure 5:
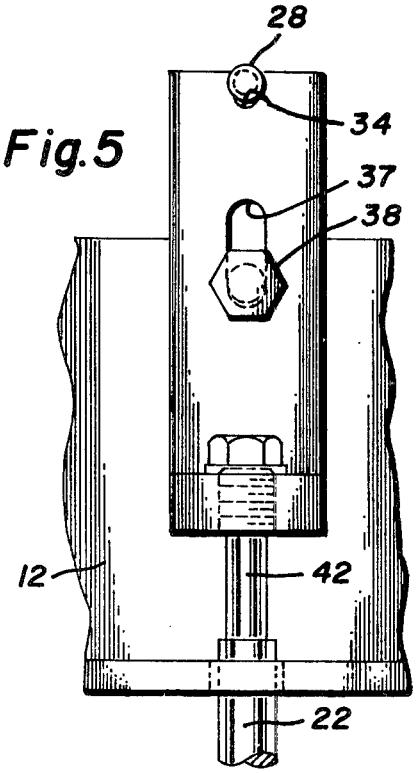
Figure 3:
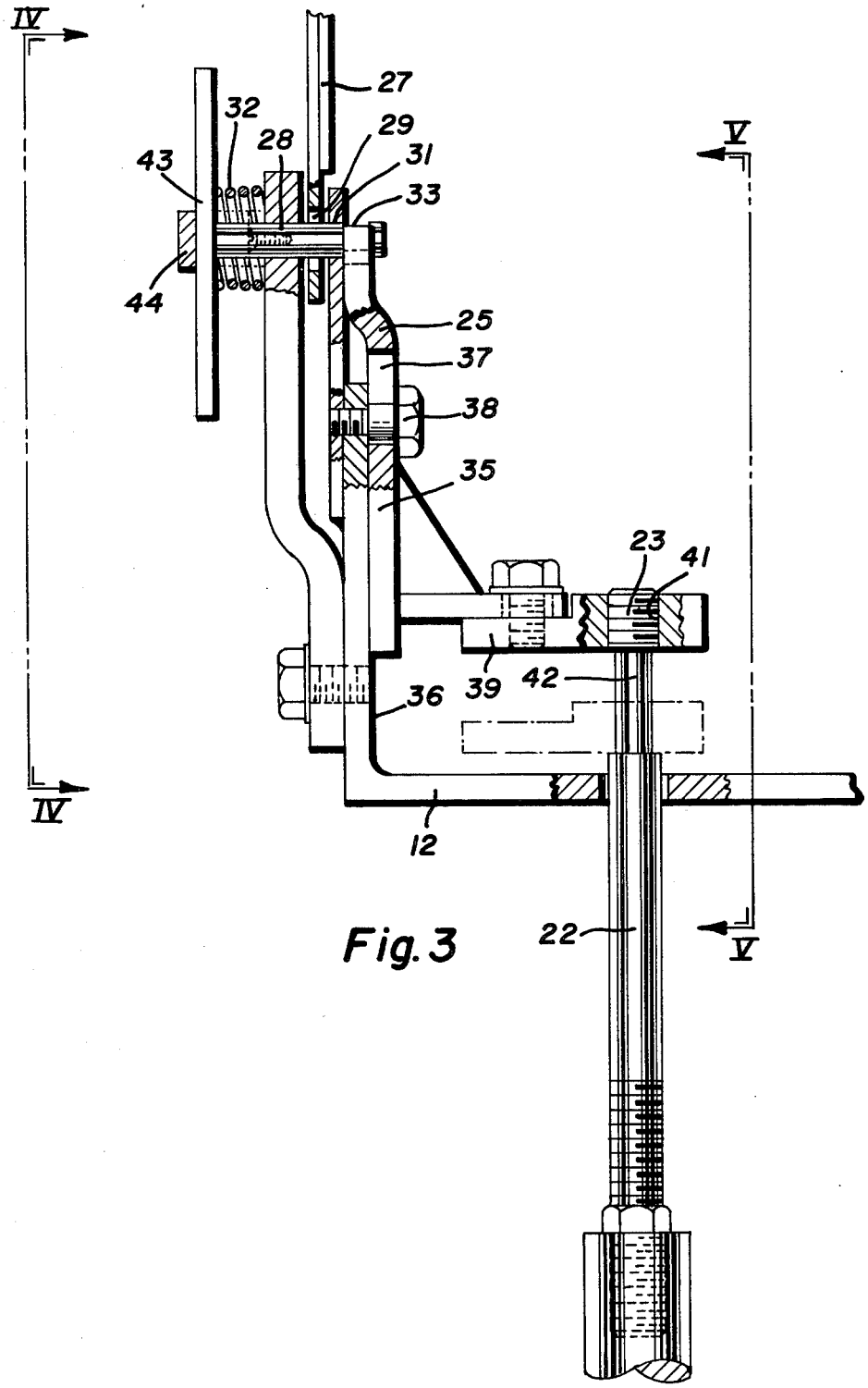

Referring next to FIGS. 3, 4, and 5, it can be seen that the said other end of the fusible link 27 is connected to the frame 12 by means of a pin 28 that slides in an aperture 29 in the link as well as an aperture 31 in an extension of the frame 12. The pin is associated with a spring 32 which is normally under compression and which urges the pin toward a position entirely removed from both apertures 29 and 31. When the pin is allowed to move out of the apertures in this way, the latch 24 releases the door 14, so that it moves to the open position. The pin 28 is provided with a groove 33 adjacent one end and the locking element 25 has a notch 34 that engages the groove to normally prevent the spring 32 from moving the pin. The locking element 25 is slidably mounted on the frame 12 for movement by rotation of the said threaded portion 23 of the spindle. The locking element is generally L-shaped with a vertical leg 25 which lies along a vertical surface 35 on the extension of the frame 12. It is formed with a vertical slot 37 through which extends a carriage bolt 38. The bolt is threaded into the frame 12, while allowing vertical sliding motion between the element 25 and the portion of the frame 12 along which it lies. Locking element 25 also has a horizontal leg 39 which has a threaded bore 41 that is engaged by the threaded portion 23 of the spindle 22. The spindle is provided with a reduced portion 42 adjacent the third portion 23, so that the locking element 25 eventually runs off the threaded portion and its threaded bore 41 lies loosely around the reduced portion. The pin 28 has an enlarged surface head 43 and the spring 32 normally lies under compression between this head and the frame 12. A bracket 44 is mounted on the frame 12 to guide the pin 28 for horizontal movement from between the apertures 29 and 31.

The operation and advantages of the present invention will be readily understood in view of the above description. The equipment is shown in the closed position indicated in FIG. 1 in which the latch 24 holds the door 14 in its downward, closed position. In that position, the fusible link 27 is intact and the pin 28 extends through the apertures 29 and 31 with its groove 33 held in place by the notch 34 of the locking element 25. In the event of an extremely hot fire, the fusible link 27 would melt first and release the latch 24 to allow the doors to be moved by the spring 15 into the open position. However, if the first has not progressed long enough to cause the fusible link to melt and indicators show the presence of a fire, the controls actuate the flow of liquid into the manifold 18 and out through the various nozzles, so that flow of fluid through the housing will be started. One of the nozzles is directed toward the turbine 19 and will cause the spindle 22 to turn. This causes the fan 21 to rotate and cause flow of the air directly down through the housing 17 and outwardly through the discharge screen 26. In order to accomplish this, however, it is necessary and desirable that fresh air be supplied to the upper end of the housing 17 rather than products of combustion, hot air, and the like. Therefore, the instant that the spindle 22 begins to rotate, its threaded portion 23 starts to turn in the threaded bore 41 in the locking element 25. The locking element begins to move downwardly and, eventually, the notch 34 leaves the groove 33 in the pin 28. Spring 32 is, therefore, able to act on the head 43 of the pin to cause the pin to move to the left (in FIG. 3) guided in its travel by the bracket 44. As soon as the pin leaves the apertures 29 and 31, the link 27 is allowed to move vertically, so that the latch 24 releases the door and allows the spring 15 to lift the door 14 into open position. With the door open, fresh air is allowed to flow into the housing 17 of the foam generator. It can be seen then that the present invention serves a dual purpose. The venting by opening the door 14 takes place in response to the sensor which starts the foam generator 16, thus allowing a release of hot gases and at the same time providing cold, fresh air for use in the foam. This has the advantage, of course, of providing foam which is cool and, therefore, has an optimum cooling effect on the fire. Passing cool air through the foam generator, of course, gives it with a longer life, because hot gases are not passing over the operative elements. The heat-fusible link 27 remains in place, of course, to act as an override for the entire apparatus, thus providing for the event of a fire that operates very quickly and before the foam generator can get into full operative relationship to the fire. The present invention lends itself to application to conventional venting doors with little added expense or equipment either during the original installation or during retro-fitting.

It is obvious that minor changes may be made in the form and construction of the invention without departing from the material spirit thereof. It is not, however, desired to confine the invention to the exact form herein shown and described, but it is desired to include all surch as properly come within the scope claimed.

I claim:

1. Fire fighting apparatus, comprising:

(a) an air vent consisting of a frame adapted to be mounted on the roof of a building and of a spring-loaded door hingedly mounted on the frame for movement from a closed position to an open position, (b) a foam generator comprising a housing mounted on the frame and carrying a manifold adapted to receive fluid and a spindle rotatably carried in the housing, the spindle carrying a turbine wheel for rotation by the fluid and a fan for forming a flow of air to mix with the fluid to form foam, the spindle having a threaded portion, (c) a latch retaining the door in the closed position, and (d) a locking element that is engaged by the threaded portion of the spindle and is moved when the spindle rotates to actuate the latch and release the door, so that it moves from closed position to open position said spindle being rotated when a sensor starts the foam generator in the presence of a fire.

2. Fire fighting apparatus as recited in claim 1, wherein the housing of the foam generator is of a generally-tubular shape and has a perforated discharge screen at its lower end.

3. Fire fighting apparatus as recited in claim 1, wherein the latch is attached to one end of a heat-fusible link, the other end of which is connected to the frame to normally hold the latch in locking position and the door in closed position.

4. Fire fighting apparatus as recited in claim 3, wherein the said other end of the fusible link is connected to the frame by a pin that slides in an aperature in the link and an aperature in the frame.

5. Fire fighting apparatus as recited in claim 4, wherein the pin is associated with a spring that urges it toward a position entirely removed from both apertures, at which position the latch is allowed to release the door, so it moves to the open position.

6. Fire fighting apparatus as recited in claim 5, wherein the pin is provided with a groove adjacent one end, wherein the said locking element has a notch that engages the groove to normally prevent the spring from moving the pin, and wherein the locking element is slidably mounted on the frame for movement by the said threaded portion of the spindle.

7. Fire fighting apparatus as recited in claim 6, wherein the said locking element is generally L-shaped with a vertical leg that lies along a vertical surface of the frame and is formed with a vertical slot through which a bolt extends into the frame while allowing vertical sliding motion, and wherein the locking element has a horizontal leg which has a threaded bore that is engaged by the threaded portion of the spindle.

8. Fire fighting apparatus as recited in claim 7, wherein the spindle is provided with a reduced portion adjacent the threaded portion, so that the locking element eventually runs off the threaded portion and its threaded bore lies loosely around the reduced portion.

9. Fire fighting apparatus as recited in claim 8, wherein the pin has an enlarged head and wherein a bracket is attached to the frame to guide the pin in horizontal movement through the apertures.

* * * * *